United States Patent [19]

Wasley et al.

[11] 3,932,124

[45] Jan. 13, 1976

[54] PROCESS FOR SETTING TEXTILES

[75] Inventors: William L. Wasley, Pacific Grove; Allen G. Pittman, El Cerrito, both of Calif.

[73] Assignee: The United States of America as represented by the Secretary of Agriculture, Washington, D.C.

[22] Filed: Sept. 9, 1974

[21] Appl. No.: 504,643

Related U.S. Application Data

[63] Continuation-in-part of Ser. No. 436,264, Jan. 24, 1974.

[52] U.S. Cl. ..... 8/127.5; 8/128 R; 8/130.1; 428/270

[51] Int. Cl.[2] ..... D06M 3/02

[58] Field of Search ..... 8/127.5, 128 R, 130.1; 117/141; 428/270

[56] References Cited

UNITED STATES PATENTS

| | | | |
|---|---|---|---|
| 2,400,377 | 5/1946 | Speakman | 8/128 R |
| 2,740,727 | 4/1956 | Littleton | 117/141 |
| 3,102,774 | 9/1963 | Koenig | 117/141 |
| 3,514,249 | 5/1970 | Bullington | 8/130.1 |
| 3,617,204 | 11/1971 | Pirie | 8/130.1 |

OTHER PUBLICATIONS

Chem. Abst., 49: 5866, 1955.

*Primary Examiner*—Theodore Morris
*Attorney, Agent, or Firm*—M. Howard Silverstein; William Takacs; Max D. Hensley

[57] ABSTRACT

Wool or other protein textiles are provided with a durable set by arranging them in a predetermined pattern, and while constrained in such pattern contacting them with a hydroxylic liquid—i.e., ethylene glycol, propylene glycol, glycidol, glycerol, or diethylene glycol—under controlled conditions of time and temperature.

12 Claims, No Drawings

PROCESS FOR SETTING TEXTILES

This is a continuation-in-part of our co-pending application, Ser. No. 436,264, filed Jan. 24, 1974.

DESCRIPTION OF THE INVENTION

The invention relates to and has among its objects the provision of novel procedures for setting wool or other protein textile, that is, for imparting to the textile durable creases, pleats, folds, or other structural arrangements as may be desired by the operator. Further objects of the invention will be evident from the following description wherein parts and percentages are by weight unless otherwise specified.

In the following description the application of the invention to wool is emphasized. This is by way of example, not limitation. In its broad compass the invention may be utilized for the setting of all kinds of proteinous textiles.

Wool is a very useful fiber and is employed in the fabrication of numerous articles, particularly weaving apparel. It is well-known that garments of all types need to be provided with some sort of fabric arrangement, for example, pleats, creases, folds, etc. Such arrangements are conventionally produced by ironing the garment while constrained in the desired pattern. However, these arrangements are but temporary and when the garment is subjected to wear or is exposed to humid conditions, the creases, pleats, etc. disappear, leaving the garment in a shapeless condition. Procedures are also known wherein chemicals such as sodium bisulphite or ethanolamine are applied to the textile which is then steamed while held in the desired pattern. Although such procedures provide better results than pressing alone, the setting is not durable so that when the garment is laundered, the creases, pleats, or other arrangements are largely dissipated. Another disadvantage resulting from setting with bisulphites and/or amines is that they impart disagreeable odors to the product and these odors are intensified when the product is subjected to moisture and warmth, for example, when the treated garments are worn in warm or humid places.

The present invention provides a means for obviating the problems outlined above. A primary advantage is that the fabric arrangements provided by the invention are durable, that is, they are essentially permanent in practical consideration. The treated textiles may be subjected to soaking in cold or even boiling water without loss of the structure imparted thereto. Garments treated in accordance with the invention may be worn in the rain or subjected to other humid conditions without less of pleats, creases, etc. The treated textiles may be subjected to dry cleaning or even washing in conventional aqueous soap or detergent formulations with little or no detriment to the creases, pleats, or other arrangements as may be present.

A most significant advantage of the invention is that the durable arrangements are established without impairing the desirable properties of the textile. That is to say, such properties as color, hand, elasticity, porosity, resilience, strength, wear-resistance, etc. are not harmed. For example, textiles treated in accordance with the invention exhibit essentially the same hand as the original fabric. This is in utter contrast to prior processes which depend for their effectiveness on the application of shellac, gums, starches, resins, or other high-molecular weight materials. In those cases there is a substantial stiffening of the material so that the original hand of the fabric is impaired.

Another advantage of the invention is that no unpleasant odor is imparted to the textile. Other items to be mentioned are that the agents used in the process are inexpensive, commercially-available, and non-corrosive. Moreover, the process is outstanding in its utter simplicity and efficiency.

A further advantage is that the invention has extensive utility and can be applied to textiles which consist entirely of protein fibers (e.g., wool; mohair; silk; camel or other animal hair; regenerated protein fibers such as those prepared from casein, soybeans, peanut protein, zein, gluten, egg albumin, collagen, or keratins such as feathers, animal hoof or horn, etc.) and to textiles which contain at least 25% of protein fibers, typically blends of wool or other protein fibers with other natural or synthetic fibers such as cotton, linen, hemp, jute, ramie, sisal, cellulose acetate, cellulose acetate-butyrate, saponified acetate rayons, viscose rayons, cuprammonium rayons, ethyl cellulose, polyurethane, polyacrylonitrile, polyesters such as polyethylene terephthalate, and the like. The term "proteinous textile" is used herein as inclusive of all-protein textiles and blends which contain at least 25% protein fibers. The textile material to which the invention is applied may be in the form of bulk fibers, yarns, sliver, roving, top, webbing, card, tape, or woven or knitted fabrics, garments, or garment parts.

As noted above, an advantage of the invention is that it does not cause any damage to the intrinsic properties of the textile. Thus it does not decrease such vital attributes as hand and abrasion resistance. As a consequence, the treated textiles are suitable for all conventional uses of textiles as in fabrication of suits, shirts, skirts, and garments of all kinds. It is further to be noted that the process of the invention is outstanding in its simplicity and can be carried out with conventional equipment to be found in any textile-treating plant.

Another advantage of the invention is that the herein-described procedure may be used in conjunction with conventional textilefinishing techniques—such as dyeing, shrinkproofing, setting, and the like—without interfering with the results attained by such finishing treatments. In fact, enhanced results are often attained as explained below.

An additional advantage of the invention is that the treated textiles are more easily dyed in that they have enhanced dye-receptivity. Moreover, the treated fibers can be dyed by conventional dyes and the imparted colors are essentially permanent and not removed by laundering.

In our copending application (Ser. No. 436,234) referred to above, we have described a process for increasing the stretchability of wool textiles by contacting the textile with a hydroxylic liquid under controlled conditions of time and temperature. The instant process is related to that of 436,234 in that the same hydroxylic liquids are used (ethylene glycol, propylene glycol, glycidol, glycerol, or diethylene glycol) and they are applied under the same conditions of time and temperature. However, the instant process differs from 436,234 in the following respect:

In a practice of the present invention, the textile is first arranged in a desired pattern. This arrangement may involve laying the material flat, or folding the material, or arranging it in desired creases or pleats, or shaping it on suitable mandrels or dies. For example, in applying the process to garments, these articles are laid on a flat surface with the desired areas folded over, creased, or otherwise arranged as conventional in preparing garments for pressing. Where more complex configurations are involved the textile may be compressed between dies having the desired shape. For example, ribbed effects may be obtained by constraining the fabric between dies having corrugated surfaces; pleated effects may be obtained by constraining the fabric between dies having mating V-shaped projections. Yarns may be crimped by compressing between corrugated surfaces, by knitting them into fabrics, by twisting them about themselves or about a rod, or by forcing them into a stuffing box. Further extensions of these principles will be obvious to those versed in the textile art.

In any event, the textile while constrained in the arranged pattern is contacted, under particular conditions, with any one of certain hydroxylic liquids, namely, ethylene glycol, glycidol, propylene glycol, glycerol, or diethylene glycol. The conditions of the treatment have been found to be critical and the desired results are attained by a correlation of time and temperature for each particular liquid.

In the case of treatment with ethylene glycol or glycidol, the temperature of treatment may range from 120° to 180° C., and the time of treatment is governed by the equation -

$$T = 175 \pm 10 - 16.7 \log t \qquad (I)$$

wherein T is the temperature in degrees Centigrade, and t is the time in seconds.

By operating within the limits of Equation I, the desired results of the invention are realized. Most importantly, the desired durable set is imparted to the textile. Moreover, by operating under such conditions, there is little or no discoloration of the textile, it suffers little or no loss of tensile strength, and it retains its original hand. Typical examples of operating conditions within the limits of Equation I are given below by way of illustration:

| Temp., °C | Time, sec. |
|---|---|
| 140 | 31 to 495, preferably 260 |
| 150 | 8 to 124, preferably 30 to 60 |
| 160 | 2 to 31, preferably 16 |

Our researches have shown that both under- and over-treatment are undesirable since they do not attain the results of the invention. For example, if the process is carried out at a selected temperature within the specified range but for a time less than that calculable from Equation I, a useful set is not attained. Any degree of set which may be obtained is not durable, and disappears when the textile is exposed to water. Moreover, if the time is increased above that calculable from the equation, inferior results are also obtained. These include discoloration, weakening of the fibers, and deterioration of hand so that in aggravated cases the product is rubbery when wet but boardy and brittle when dry.

In the case of treatment with propylene glycol, glycerol, or diethylene glycol, the temperature may range from 140° to 180° C., and the time of treatment is governed by the equation -

$$T = 188 \pm 8 - 16.7 \log t \qquad (II)$$

wherein T is the temperature in degrees Centigrade, and t is the time in seconds.

In the same way as explained above, if the treatment is carried out at times or temperatures below or above those governed by Equation II, inferior results are obtained. Typical examples of operating conditions within the limits of Equation II are given below by way of illustration:

| Temp., °C | Time, sec. |
|---|---|
| 150 | 63 to 562, preferably 300 |
| 160 | 16 to 142, preferably 130 |
| 170 | 4 to 34, preferably 20 |

Contact between the hydroxylic liquid and the constrained textile may be accomplished in various ways. The simplest and preferred method is to immerse the constrained textile in a heated bath of the hydroxylic liquid. After the period of time necessary to produce the benefits of the invention, the textile is removed from the bath, and while still under constraint, is immediately cooled to below 100° C.—usually to room temperature—in order to quench (arrest) the reaction.

In an alternative procedure the treatment with the hydrolytic liquid is carried out as follows: The constrained textile is impregnated with the selected hydrolytic liquid and passed through an oven or other heating chamber wherein it is brought to the desired temperature and held thereat for the appropriate time. The treated textile is then removed from the oven and immediately cooled while still under constraint.

Other methods for effecting contact between the hydroxylic liquid and the constrained textile will be obvious to those skilled in the art. It should be noted that the process of the invention is readily adapted to continuous or batch procedures, whichever is desired.

The cooling operation can be carried out in various ways. For example, the treated textile while still constrained can be immersed in cold (tap) water, or in water which is cooled by addition of ice or by the use of refrigerated coils, or the like. Alternatively, the constrained textile can be cooled by subjecting it to a blast of cold air or a spray of cold water or carbon dioxide snow. Another plan is to cool the constrained textile by contact with a chilled non-aqueous inert liquid such as trichloroethane, perchloroethane, hexane, or a fluorocarbon such as difluorodichloromethane. After cooling, the textile need no longer be held under constraint; the setting has been accomplished.

After cooling, the textile is treated to remove any hydroxylic liquid which remains on it. Since the hydroxylic liquids are soluble in water, this is most readily accomplished by washing with water. Alternatively, the residual hydroxylic liquid is removed by washing with a non-aqueous, volatile, inert solvent such as methanol, ethanol, trichloroethane, perchloroethylene, and the like.

After removal of residual hydroxylic liquid, the treated textile is dried in conventional manner and is then ready for use or sale.

In an alternative modification of the invention, a minor amount (about 0.01 to 0.5%) of an acid is added to the hydroxylic liquid prior to contact with the textile, whereby to minimize possibility of discoloration of the textile. For this purpose one can use acids such as p-toluene sulphonic acid, benzene sulphonic acid, sulphuric acid, sulphamic acid, phosphoric acid, hydrochloric acid, ascorbic acid, etc. Preferably, p-toluene sulphonic acid is used in a concentration of about 0.2%.

EXAMPLES

The invention is further demonstrated by the following examples provided by way of illustration and not limitation.

EXAMPLE 1

A sample of mohair top was arranged in a thin layer between two stainless steel screens with mating serrated configuration which imparted crimp to the fibers. The assembly was immersed for 1 minute in ethylene glycol (at a temperature of 150° C.) which contained 0.2% p-toluene sulfonic acid. The assembly was removed from the bath and rinsed for a minute in running tap water (16 to 20° C.). The crimped fibers were removed from the assembly and were dried. The fibers retained their crimped configuration even after being placed in boiling water for 30 minutes.

EXAMPLE 2

The procedure described in Example 1 was applied to a sample of wool top. The imparted crimp was retained although the treated sample was immersed in boiling water for 30 minutes.

EXAMPLE 3

Very tightly-knit fabrics were made from fine crimp-free mohair yarn and from coarse, relatively crimp-free, carpet wool yarn. These knitted materials were each immersed for 60 seconds in ethylene glycol at a temperature of 150°–152° C. The treated knits were removed from the bath, were rinsed in cool tap water, and then were dried.

The treated fabrics were unraveled and the recovered yarns examined. It was found that in both cases, the yarns had acquired a high degree of crimp. For example, microscopic examination of the treated mohair yarn revealed that the individual fibers had a high degree of crimp, whereas the untreated mohair fibers were characteristically smooth and lacking in crimp. The crimped yarns could be re-knit to form fabrics having a desirable high bulk and greatly improved resiliency.

EXAMPLE 4

Samples of wool fibers and mohair fibers were wound tightly around a glass rod (about 3/16 inch diameter). The assembly was immersed in ethylene glycol at 145° C. for a period of 75 seconds. Afterward, the assembly was removed from the bath, was rinsed with tap water, and was dried. The treated fibers were removed from the rod and they exhibited a curled configuration, which was retained even after prolonged soaking in hot water.

EXAMPLE 5

A worsted wool fabric (4.5 oz. per sq. yd., plain weave) was constrained in a pleated configuration between two stainless steel screens having mating V-shaped conformation. The assembly was immersed for 60 seconds at a temperature of 150° C. in ethylene blycol containing 0.2% p-toluene sulfonic acid. After this treatment the assembly was immersed in cool water. The wet fabric was removed from the assembly and was dried. The sharply-pleated fabric was immersed in boling water for 30 minutes after which time the pleats still remained.

Control: A similar piece of fabric was treated conventionally to set pleats. Thus, the fabric was constrained in the same stainless steel screen as above. The assembly was immersed for 5 min. in a boiling 2% solution of sodium bisulfite, was removed from the bath and rinsed with water, and finally was dried. The fabric was removed from the assembly and was immersed in boiling water. After 20 min. the imparted pleats were only slightly retained.

EXAMPLE 6

A plain weave, worsted wool fabric (6.2 oz. per sq. yd.) was treated in a conventional manner to impart shrinkproofing. The conventional process entailed treating the fabric with a 2% solution of a commercial shrinkproofing agent (a polyurethane having terminal isocyanate groups) in perchloroethylene, pressing the so-treated material in a Hoffman steam press, and curing the fabric at 65% RH and 70° F. for one week.

A 10 in. × 14 in. swatch of the shrink-proofed fabric was constrained in both the warp and fill directions in a pin-tenter frame (device with pins on a frame useful for constraining fabrics). The assembly was immersed for 60 seconds at 150° C. in ethylene glycol containing 0.1% p-toluene sulfonic acid and then was rinsed with cool water and dried.

The so-treated fabric exhibited a desirable flat set, which was retained after repeated aqueous launderings.

The treated fabric was tested for retention of smoothness as follows. It was subjected to three washings and tumble dryings. The triple-washed fabric was then evaluated according to AATCC test method 88A-III-C, using overhead lighting procedure. In this test the fabric is rated on a scale of 1 to 5, with 5 being the most smooth and 1 being the least smooth. The treated fabric gave a rating in this test of 4.5. As a control, a sample of the same fabric was subjected to the shrinkproofing treatment alone. This fabric when tested as described had a smoothness rating of only 2.

Having thus described our invention we claim:

1. A method for imparting a stable set to a proteinous textile, which consists of - a. arranging the textile in a predetermined pattern, b. while constraining it in such pattern immersing the textile in a bath consisting of ethylene glycol at a temperature in the range 120 to 180° C. and for a time governed by the limits of the equation -

$$T = 175 \pm 10 - 16.7 \log t$$

wherein T is the temperature in degrees Centigrade, and t is the time in seconds, c. while still constraining the textile in the predetermined pattern immediately arresting the treatment by cooling the textile, d. washing the textile to remove residual ethylene glycol, and drying the textile.

2. The method of claim 1 wherein the bath consists of ethylene glycol and about 0.2% of p-toluene sulfonic acid.

3. A method for importing a stable set to a proteinous textile, which consists of a. arranging the textile in a predetermined pattern, b. while constraining it in such pattern immersing the textile in a bath consisting of ethylene glycol at a temperature of about 150° C. for a period of about 30 to 60 seconds, c. while still constraining the textile in the predetermined pattern immediately quenching the so-treated textile in cold water, d. washing the textile with water to remove residual ethylene glycol, and drying it.

4. The method of claim 3 wherein the bath consists of ethylene glycol and about 0.2% of p-toluene sulfonic acid.

5. A method for imparting a stable set to a proteinous textile, which consists of a. arranging the textile in a predetermined pattern, b. while constraining it in such pattern immersing the textile in a bath consisting of glycidol at a temperature in the range 120° to 180° C. and for a time governed by the limits of the equation -

$T = 175 \pm 10 - 16.7 \log t$ wherein T is the temperature in degrees Centigrade, and t is the time in seconds, c. while still constraining the textile in the predetermined pattern immediately arresting the treatment by cooling the textile, d. washing the textile to remove residual glycidol, and drying the textile.

6. The method of claim 5 wherein the bath consists of glycidol and about 0.2% of p-toluene sulfonic acid.

7. A method for imparting a stable set to a proteinous textile, which consists of a. arranging the textile in a predetermined pattern, b. while constraining it in such pattern immersing the textile in a bath consisting of propylene glycol at a temperature in the range 140° to 180° C. and for a time governed by the limits of the equation $T = 188 \pm 8 - 16.7 \log t$ wherein T is the temperature in degrees Centigrade, and t is the time in seconds, c. while still constraining the textile in the predetermined pattern immediately arresting the treatment by cooling the textile, d. washing the textile to remove residual propylene glycol, and drying the textile.

8. The method of claim 7 wherein the bath consists of propylene glycol and about 0.2% of p-toluene sulfonic acid.

9. A method for importing a stable set to a proteinous textile, which consists of - a. arranging the textile in a predetermined pattern, b. while constraining it in such pattern immersing the textile in a bath consisting of glycerol at a temperature in the range 140° to 180° C. and for a time governed by the limits of the equation -

$T = 188 \pm 8 - 16.7 \log t$ wherein T is the temperature in degrees Centigrade, and t is the time in seconds, c. while still constraining the textile in the predetermined pattern immediately arresting the treatment by cooling the textile, d. washing the textile to remove residual glycerol, and drying the textile.

10. The method of claim 9 wherein the bath consists of glycerol and about 0.2% of p-toluene sulfonic acid.

11. A method for imparting a stable set to a proteinous textile, which consists of a. arranging the textile in a predetermined pattern, b. while constraining it in such pattern immersing the textile in a bath consisting of diethylene glycol at a temperature in the range 140° to 180° C. and for a time governed by the limits of the equation -

$T = 188 \pm 8 - 16.7 \log t$ wherein T is the temperature in degrees Centigrade, and t is the time in seconds, c. while still constraining the textile in the predetermined pattern immediately arresting the treatment by cooling the textile, d. washing the textile to remove residual diethylene glycol, and drying the textile.

12. The method of claim 11 wherein the bath consists of diethylene glycol and about 0.2% of p-toluene sulfonic acid.

* * * * *